United States Patent [19]

Beck

[11] 4,355,685

[45] Oct. 26, 1982

[54] BALL OPERATED J-SLOT

[75] Inventor: Harold K. Beck, Duncan, Okla.

[73] Assignee: Halliburton Services, Duncan, Okla.

[21] Appl. No.: 152,162

[22] Filed: May 22, 1980

[51] Int. Cl.[3] ..... E21B 23/00

[52] U.S. Cl. ..... 166/240; 166/331; 74/57

[58] Field of Search ..... 166/240, 331; 74/57, 74/88

[56] References Cited

U.S. PATENT DOCUMENTS

| | | | |
|---|---|---|---|
| 1,233,858 | 7/1917 | Farmer | 74/57 |
| 2,280,785 | 4/1942 | Boynton | 166/240 |
| 3,054,454 | 9/1962 | Evans | 166/240 |
| 3,703,104 | 11/1972 | Tamplen | 166/240 |
| 4,101,157 | 7/1978 | Richey | 166/240 |
| 4,113,012 | 9/1978 | Evans et al. | 166/331 |

*Primary Examiner*—James A. Leppink

*Attorney, Agent, or Firm*—John H. Tregoning; James R. Duzan; Lucian Wayne Beavers

[57] ABSTRACT

A downhole tool includes inner and outer telescoping cylindrical members. The inner cylindrical member has a cylindrical indexing sleeve disposed thereabout. A groove having a semi-circular cross section is disposed in a cylindrical outer surface of the indexing sleeve. Connected to the outer cylindrical member is an apparatus for holding a spherical ball so that approximately one-half the ball is engaged with the semi-circular cross section groove and the other of the ball is disposed within a radial bore in the outer cylindrical member. Relative movement between the inner and outer cylindrical members is defined by engagement of the spherical ball with the groove. The spherical ball is biased toward the groove by a compression spring or a displaceable fluid under pressure.

24 Claims, 13 Drawing Figures

BALL OPERATED J-SLOT

The present invention relates generally to apparatus for guiding relative movement between first and second members, and more particularly, but not by way of limitation, to downhole tools including telescoping inner and outer tubular members relative movement between which is defined by a slot and lug means.

In many downhole tools for use in performing various testing and treating operations and the like on oil wells, it is desirable to interconnect telescoping inner and outer tubular members by a slot and lug means so that upon exertion of external forces upon one of the inner and outer tubular members, the motion of said one member relative to the other of the inner and outer tubular members is defined by the permissible movement of the lug within the slot. Such slot configurations are generally referred to as J-slots because they very often have the shape of the letter "J", even though many of the slots are very complex in their configurations.

On example of a very complex slot and lug mechanism is shown in U.S. Pat. No. 4,113,012 to Evans et al., and assigned to the assignee of the present invention, particularly at FIGS. 3-5 thereof.

As is apparent from viewing FIGS. 3-5 of the Evans et al. patent, such complicated lug and slot structures are relatively difficult to manufacture. Expensive millwork is required to machine such slot and lug arrangements from stock. Often it is necessary to cast some of the more complex components.

The present invention avoids the problems of manufacturing complex slot and lug structures such as that of Evans et al. by replacing the slot with a groove having a semi-circular cross-section, and by replacing the lug with a spherical ball.

Certain spherical ball structures carried in bearing races or other semi-circular grooves are known in the art. It is known in the art to provide ball bearings engaging a spiral shaped groove having a semi-circular cross-section to provide a low friction high load bearing engagement with a cylindrical object such as a rod or the like. Such structures typically have a cylindrical rod with a spiral shaped groove on the outer surface thereof, said groove having a semi-circular cross-section. A plurality of several ball bearings are spaced around a circumference of the rod and are held in place in bearing blocks. Those structures are, however, generally used merely for the purpose of providing a low friction bearing and it is not believed that any guide structure for defining the permissible relative movement between telescoping tubular members has ever been constructed utilizing a slot having a semi-circular cross-section and a lug means including a spherical ball engaging the slot.

A downhole tool of the present invention includes an outer cylindrical member having a longitudinal passageway disposed therein. An inner cylindrical member is received within the longitudinal passageway of the outer cylindrical member. The inner cylindrical member includes a cylindrical sleeve disposed thereabout and connected thereto in such a manner as to allow free rotation of the cylindrical sleeve relative to the inner cylindrical member. A cylindrical outer surface of the sleeve has disposed therein a groove having a semi-circular cross-section.

A spherical ball is engaged with the groove for movement along the groove. A holding means is provided for holding the spherical ball relative to the outer cylindrical member, so that movement of the outer cylindrical member relative to the inner cylindrical member is guided by engagement of the spherical ball with the groove. A biasing means is provided for resiliently biasing the spherical ball toward the groove.

The present invention provides several alternative embodiments of the holding means and biasing means.

Numerous objects, features and advantages of the present invention will be readily apparent to those skilled in the art upon a reading of the following disclosure when taken in conjunction with the accompanying drawings.

FIGS. 1A-1H comprise a section elevation right side only view of the downhole tool incorporating the ball and groove guide means of the present invention.

FIG. 6 is a view similar to FIG. 5 showing yet another alternative embodiment.

Figure 1A:
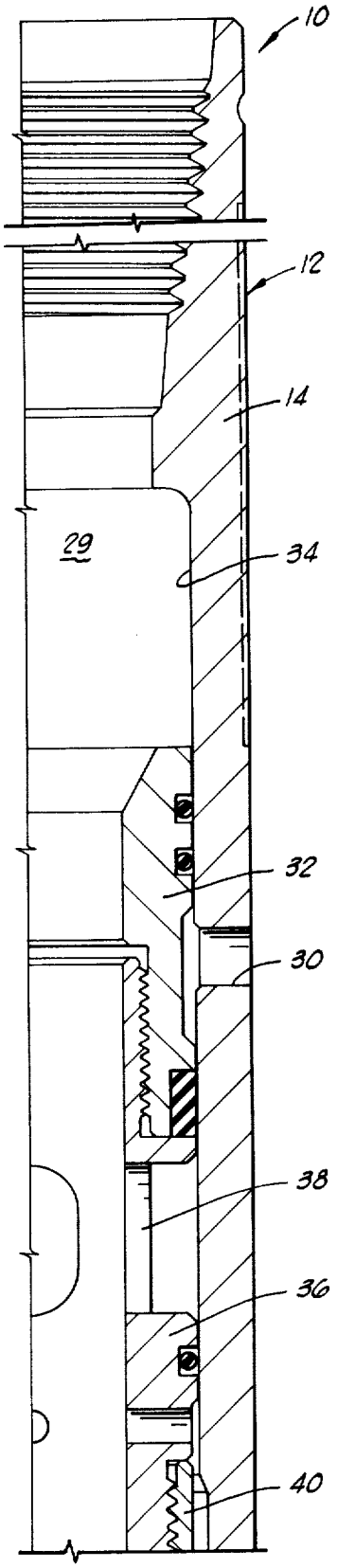

Referring now to the drawings and particularly to FIGS. 1A-1H, a downhole tool is there generally designated by the numeral 10.

The downhole tool 10 is a recloseable circulation valve for use in oil well testing, which is a slightly modified version of the circulation valve disclosed and claimed in U.S. Pat. No. 4,113,012 to Evans et al., and assigned to the assignee of the present invention. The particular manner of operation of the downhole tool 10 of the present invention is substantially the same as that described in the Evans et al. patent, which description is incorporated herein by reference. Those portions of the downhole tool 10 of the present invention, other than the components specifically related to the ball and groove guide means, will be described herein only in a brief fashion sufficient that the improvement provided by the ball and groove guide means may be appreciated.

The downhole tool 10 includes a cylindrical housing 12 which is made up of an upper housing adapter 14, an upper intermediate housing section 16, an indexing housing section 18, a passageway housing section 20, a nitrogen chamber housing 22, a lower intermediate housing section 24, an oil chamber housing 26 and a lower housing adapter 28.

Cylindrical housing 12 includes a longitudinal passageway 29 disposed therethrough, said passageway 29 being comprised of the various internal surfaces of the components of the cylindrical housing 12 just described.

Upper housing adapter 14 includes a circulation port 30 disposed through a side wall thereof. A circulation valve cover sleeve 32 is closely received within an inner bore 34 of upper housing adapter 14 and is movable between a first closed position, as shown in FIG. 1A, closing circulation port 30, an an open position opening the circulation port 30. When circulation valve cover sleeve 32 is in its open position it is displaced upwardly relative to upper adapter 14 from the position shown in FIG. 1A.

Circulation valve cover sleeve 32 is connected to a circulation valve opening mandrel 36 which has a port 38 disposed therein for communication with the circulation port 30 when the circulation valve cover sleeve 32 is moved upward to its open position. Connected to the lower end of circulation valve opening mandrel 36 is a lower circulation valve sleeve 40.

A circulation valve operating mandrel 42 is closely received within an inner cylindrical surface 44 of upper intermediate housing section 16. An operating collar 46 is threadedly attached to the upper end of circulation valve operating mandrel 42 at threaded connection 48. Operating collar 46 has a greater outer diameter than does operating mandrel 42 and includes upward and downward facing surfaces 50 and 52, respectively.

Longitudinal movement of operating mandrel 42 and operating collar 46 relative to circulation valve opening mandrel 36 and lower circulation valve sleeve 40 is limited by engagement of surface 50 with a downward facing surface 54 of circulation valve opening mandrel 36 and by engagement of surface 52 with an upward facing surface 56 of lower circulation valve sleeve 40.

Figure 1B:
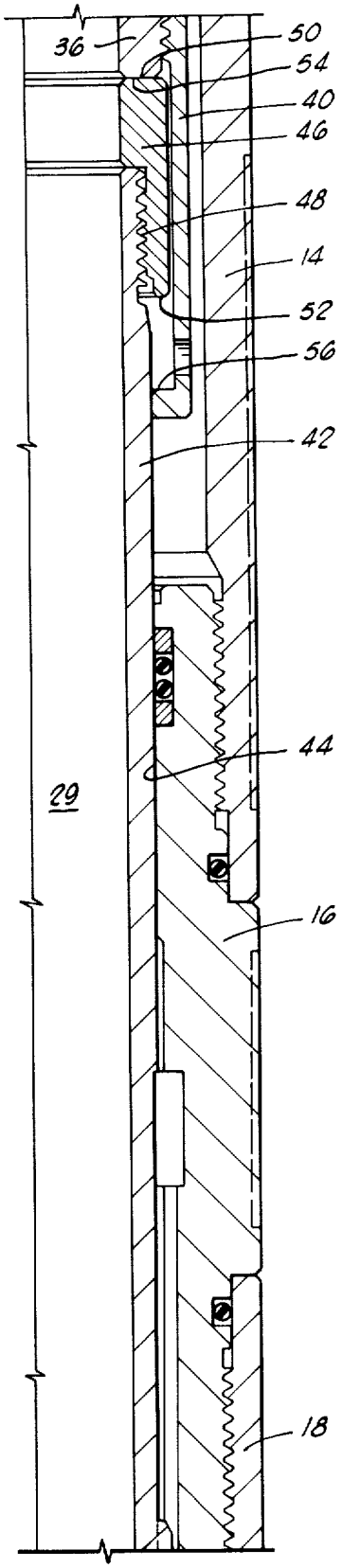

As can be seen in FIG. 1B a certain amount of longitudinal movement of operating mandrel 42 may occur prior to engagement of either of the surfaces 50 or 52 with the respective surfaces 54 and 56. Upon engagement of surface 50 with surface 54 when operating mandrel 42 is moving upward relative to cylindrical housing 12, the circulation valve opening mandrel 36 is then moved upward with operating mandrel 42 to move circulation valve cover sleeve 32 to its open position.

Upon downward movement of operating mandrel 42, when surface 52 engages surface 56, further downward movement of operating mandrel 42 moves circulation valve opening mandrel 36 downward so that circulation valve cover sleeve 32 is moved to its closed position.

Figure 1C:
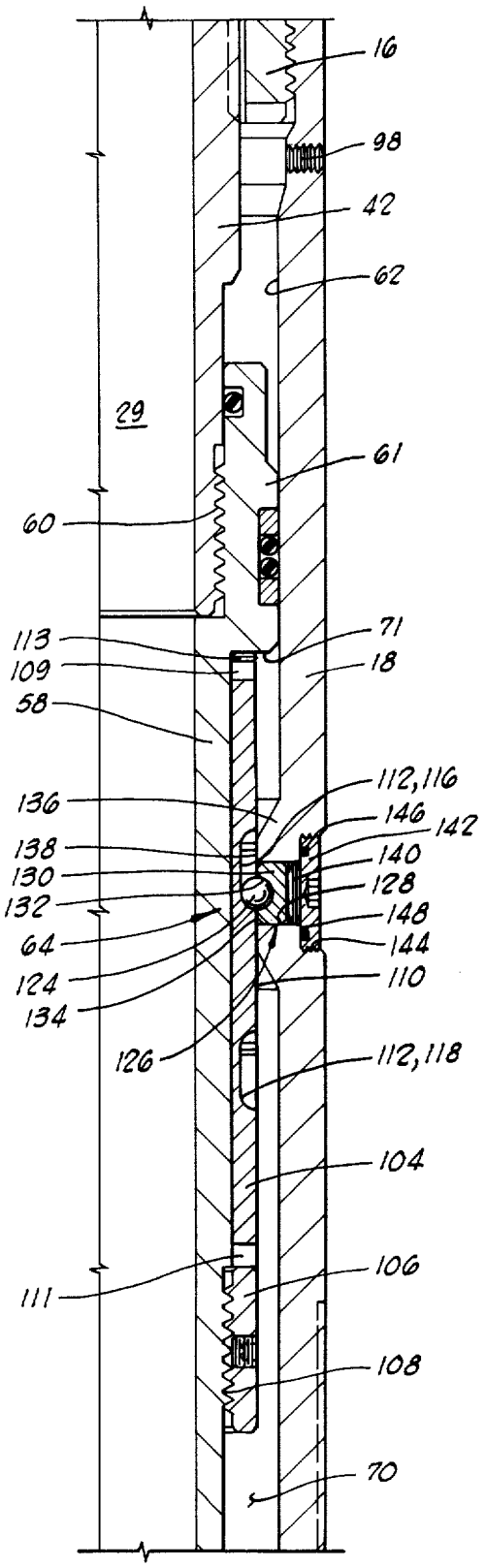
Figure 1D:
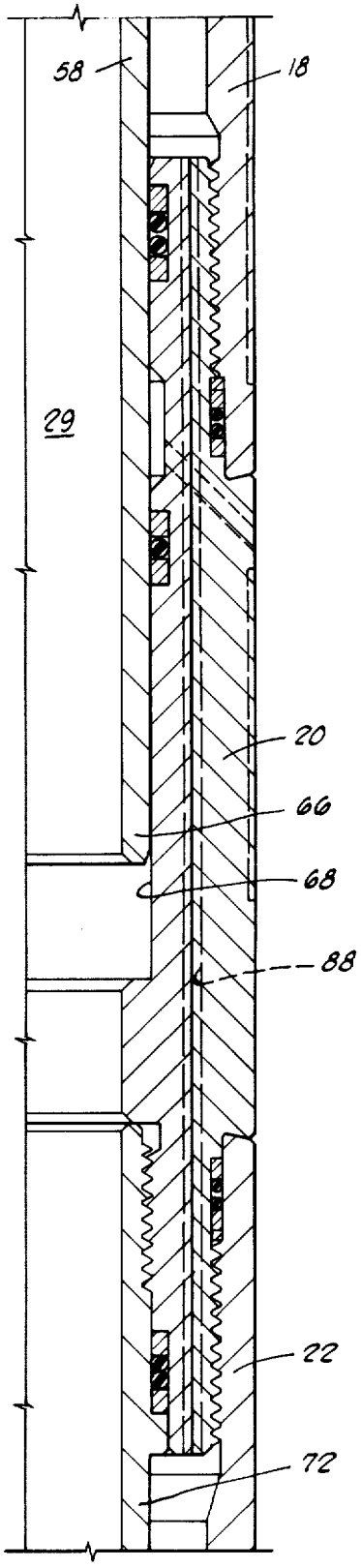
Figure 1E:
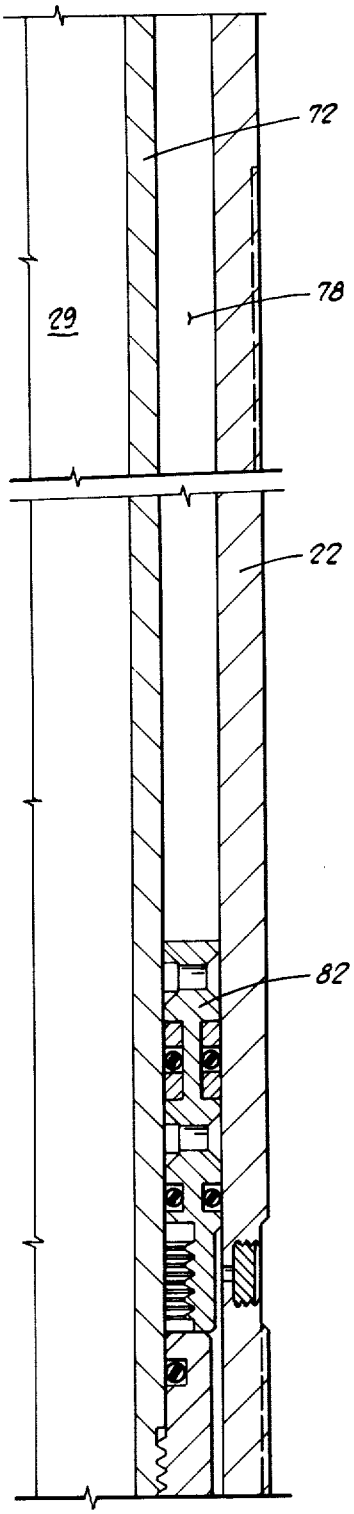

Referring now to FIG. 1C, the lower end of circulation valve operating mandrel 42 is threadedly connected to a piston mandrel 58 at threaded connection 60. Piston mandrel 58 includes an annular power piston 61 formed on the upper end thereof which is closely received within an inner cylindrical surface 62 of indexing section housing 18. A lug and slot type indexing section or guide means generally designated by the numeral 64 is connected between piston mandrel 58 and indexing housing section 18 of housing 12 to define the permissible relative movement between piston mandrel 58 and the components attached thereto relative to the cylindrical housing 12. The indexing section 64 is described in more detail below after the completion of the general description of the downhole tool 10.

A lower end 66 of piston mandrel 58 is closely received within an inner cylindrical surface 68 of passageway housing section 20.

An annular space 70 is defined between piston mandrel 58 and cylindrical housing 12 and is communicated with a lower end 71 of power piston 61.

Figure 1F:
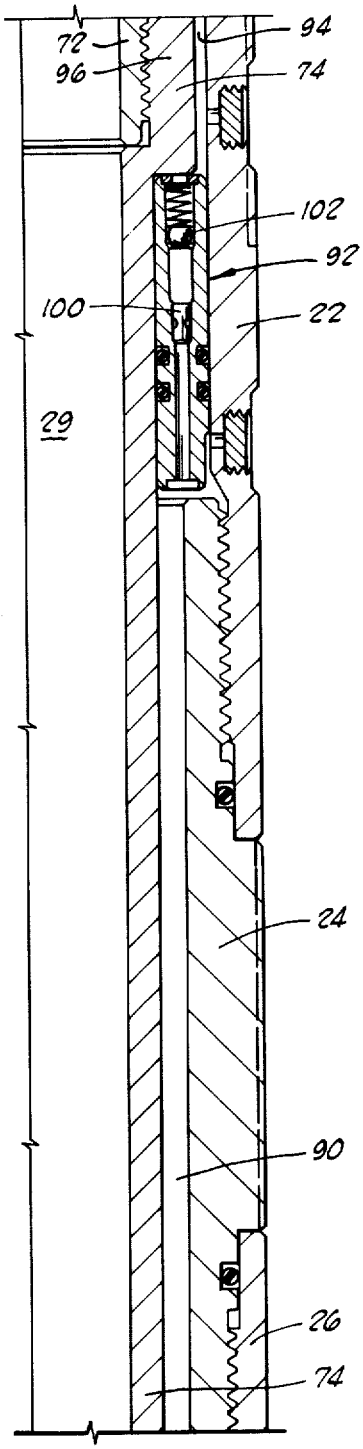
Figure 1G:
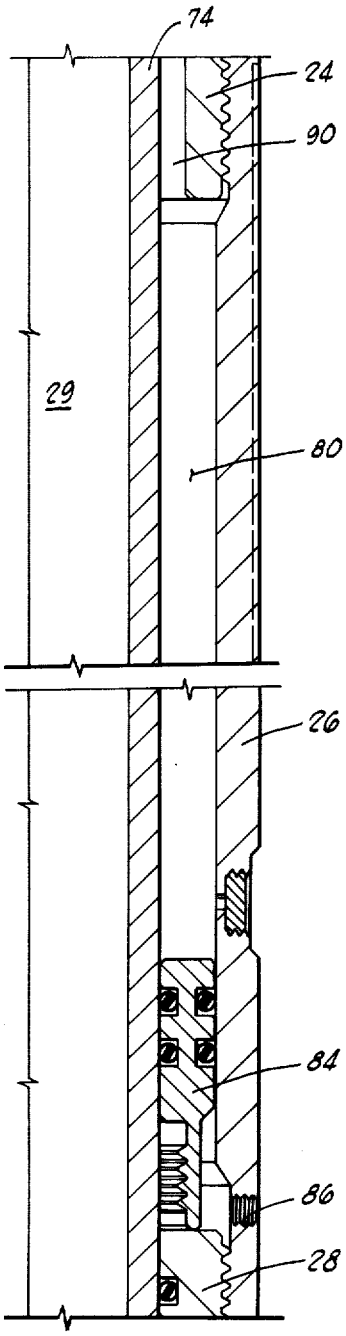
Figure 1H:
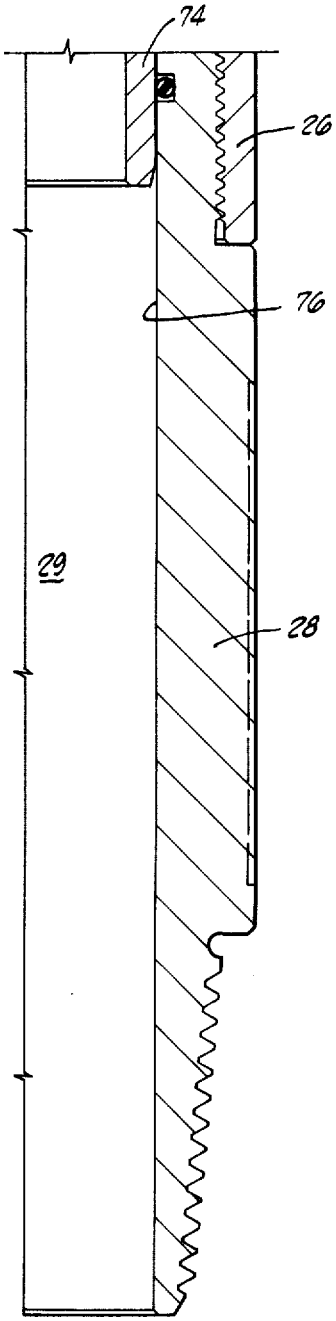

Connected to an internally threaded lower end of passageway housing section 20 is an upper inner tubular sleeve 72. Attached to the lower end of sleeve 72, as seen in FIG. 1F, is a lower inner tubular sleeve 74. A lower end of lower inner tubular sleeve 74 is closely received within an inner bore 76 of lower housing adapter 28, as shown in FIG. 1H.

Defined between upper inner tubular sleeve 72 and nitrogen chamber housing 22 of housing 12 is an annular nitrogen chamber 78.

Defined between lower inner tubular sleeve 74 and oil chamber housing 26 of housing 12 is an annular oil chamber 80.

Disposed in nitrogen chamber 78 is a first floating piston 82 which separates nitrogen in nitrogen chamber 78 from oil in oil chamber 80, and which transfers pressure therebetween.

Located in nitrogen chamber 80 is a second floating piston 84 which separates oil in oil chamber 80 from annulus fluid communicated with the lower side of second floating piston 84 through a port 86 through the side of oil chamber housing 26.

Nitrogen chamber 78 is communicated with annular space 70 through a passageway 88 disposed longitudinally through the wall of passageway housing section 20.

The lower end of first floating piston 82 is communicated with oil chamber 80 through an annular space 90 defined between lower inner tubular sleeve 74 and housing 12, a flow restriction apparatus generally designated by the numeral 92, and an annular clearance 94 between an upper enlarged diameter portion 96 of lower inner tubular sleeve 74 and nitrogen chamber housing 22.

Annulus fluid is communicated with the upper end of power piston 61 through a power port 98 through the side wall of indexing housing section 18.

Flow restriction apparatus 92 includes a metering means 100 and a relief valve means 102 which allow oil to flow from annular space 90 through flow restriction apparatus 92 to annular space 94 when a pressure differential between spaces 90 and 94 exceeds a predetermined level defined by the manner of construction of the flow restriction apparatus 92.

A second flow restriction apparatus (not shown) is located in downhole tool 10 180° opposite flow restriction apparatus 92 and includes similar metering means and relief valve means which have been inverted so that upon the existence of an excess pressure in annular space 94, that excess pressure may be relieved into annular space 90.

Referring once again to the indexing section generally designated by the numeral 64 and shown in a sectional elevation view in FIG. 1C, that indexing section includes a cylindrical indexing sleeve 104 disposed about piston mandrel 58 and retained in place thereon by means of retaining collar 106 threadedly attached to piston mandrel 58 at threaded connection 108.

Thrust washers 109 and 111 are located at the ends of sleeve 104, and a spacer ring 113 is located above upper thrust washer 109. Sleeve 104 is loosely held so that it may freely rotate relative to piston mandrel 58.

Figure 2:
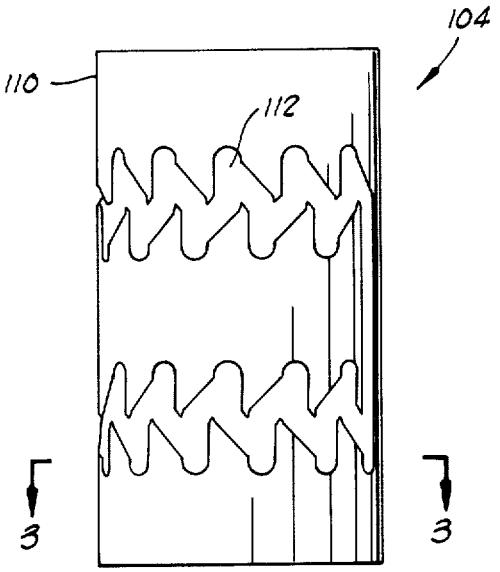
FIG. 2 is an elevation view of a cylindrical sleeve including a groove in the outer surface thereof.
Figure 4:
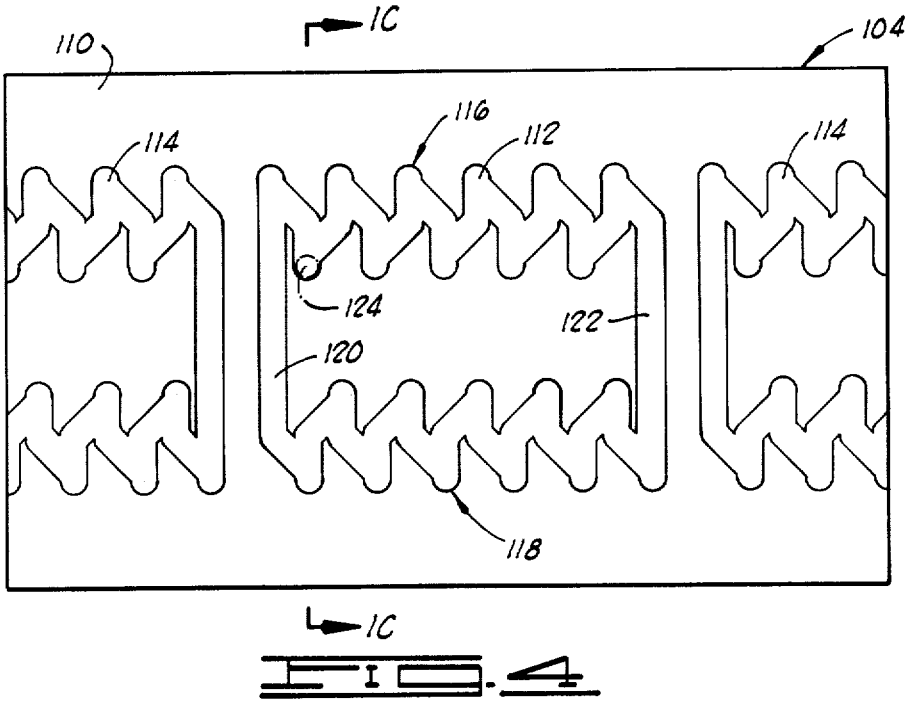
FIG.4 is a laid-out view of the sleeve of FIG. 2 showing the appearance of the sleeve as if it had been cut along its length at one side and then rolled out flat into a rectangular shape. The line 1C—1C indicates the location of the section through the sleeve which is seen in FIG. 1C.

An elevation view of indexing sleeve 104 is shown in FIG. 2. A laid-out view of indexing sleeve 104 is shown in FIG. 4.

Indexing sleeve 104 has disposed in its outer cylindrical surface 110 first and second continuous grooves or slots 112 and 114.

First groove 112 includes an upper repeating zig-zag portion 116 for rotating sleeve 104 counterclockwise as viewed from above upon reciprocation of piston mandrel 58 relative to housing 12.

Groove 112 includes a lower repeating zig-zag portion 118 for rotating sleeve 104 in a clockwise direction as viewed from above upon reciprocation of piston mandrel 58 relative to housing 12.

Slot 112 further includes first and second vertical groove portions 120 and 122 for joining the ends of the upper and lower zig-zag portions 116 and 118 to form a continuous groove 112.

Second continuous groove 114 is constructed the same as groove 112 and is located 180° therefrom around the indexing sleeve 104.

Figure 3:
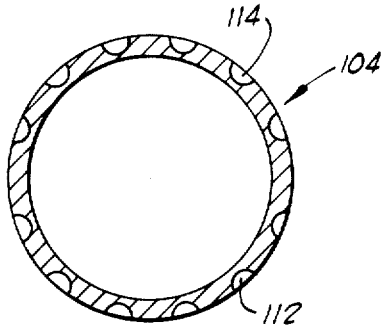
FIG. 3 is a section view taken along line 3—3 of FIG. 2.

As can be seen in FIG. 3, which is a horizontal section view taken along line 3—3 of FIG. 2, the grooves 112 and 114 have a semi-circular cross section.

Referring once again to FIG. 1C, a spherical ball 124 engages the groove 112 for movement along the groove 112. A holding means generally designated by the numeral 126 holds the ball 124 relative to housing 12 so that movement of housing 12 relative to piston mandrel 58 is guided by engagement of the ball 124 with the groove 112.

A second spherical ball (not shown) is connected to housing 12 on the opposite side of housing 12 from the ball 124 and said second spherical ball engages the second groove 114.

Holding means 126 includes a radial bore 128 disposed through the wall of indexing housing section 18 of cylindrical housing 12. The ball 124 is disposed in radial bore 128 and held in place therein by a holding block 130 closely received within radial bore 128 and having a hemispherical cavity 132 disposed in a radially inner surface 134 thereof for receiving the ball 124. Approximately one-half of ball 124 is received in groove 112, and the other half is received in cavity 132.

Indexing housing section 18 includes a radially inward projecting portion 136 having a cylindrical inner surface 138 within which the cylindrical outer surface 110 of indexing sleeve 104 is closely received.

The downhole tool 10 further includes a biasing means 140 for resiliently biasing spherical ball 124 toward groove 112, and includes a retainer means 142 for retaining spherical ball 124 in the radial bore 128. That is, retainer means 142 prevents spherical ball 124, the holding block 130, and the biasing means 140 from falling out of radial bore 128.

The retainer means 142 may further be described as a threaded plug blocking the radial bore 128 outward from the holding block 130. The threaded plug 142 is received in a threaded radial counterbore 144 located outward of radial bore 128.

An annular O-ring sealing means 146 is disposed between plug means 142 and a shoulder 148 defined between radial bore 128 and radial counterbore 144.

The biasing means 140 shown in FIG. 1C is a compression spring biasing means compressed between the plug 142 and the holding block 130. Compression spring biasing means 140 is preferably a Belleville type spring.

Figure 5:
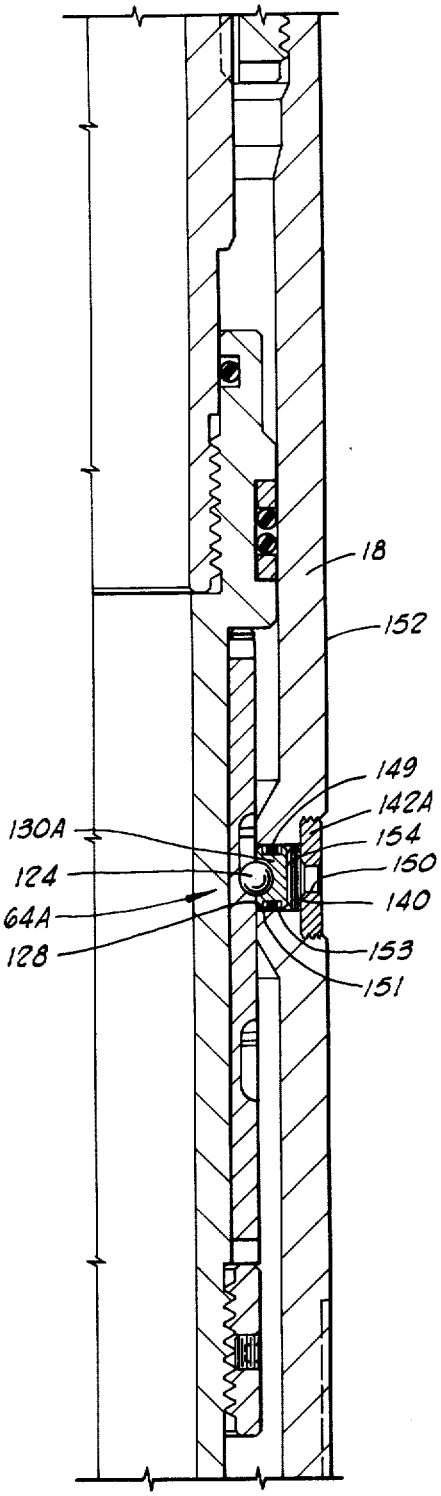
FIG. 5 is a view similar to FIG. 1C showing an alternative embodiment of holding means, biasing means and retainer means for mounting the spherical ball in the outer cylindrical member.
Figure 5:
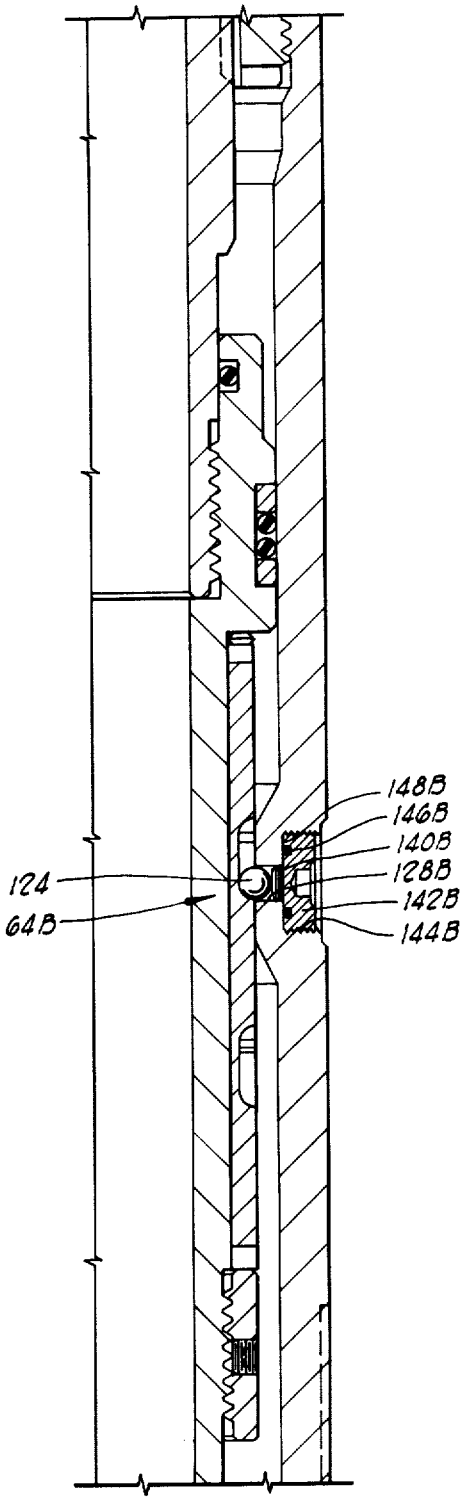

Referring now to FIG. 5, a view is thereshown similar to FIG. 1C in all respects except for the construction of the indexing means 64. Several of the components of the indexing means 64A of FIG. 5 differ from the indexing means 64 of FIG. 1C as follows. Identical components are indicated with the same reference numerals used in FIG. 1C. Modified components are indicated by a suffix "A".

An annular O-ring sealing means 149 is disposed between a holding block 130A and radial bore 128. Back up rings 151 and 153 are provided on each side of seal 149.

A threaded plug retainer means 142A includes a fluid passage means 150 disposed therethrough for communicating radial bore 128 with an outer surface 152 of indexing housing section 18.

As will be understood by those skilled in the art, when the downhole tool 10 is in place within an oil well, the outer surface 152 will be in communication with the annulus between a drill string to which the downhole tool 10 is attached and the oil well bore hole or casing so that annulus fluid is communicated with the radial bore 128 through the passage means 150.

With the addition of the fluid passage means 150 in the retainer plug 142A, an additional biasing means is provided due to the effect of the pressurized column of fluid in the annulus between the downhole tool 10 and the well borehole. This column of fluid may generally be described as a displaceable fluid under pressure communicated with a radially outer end 154 of holding block 130A through the fluid passage means 150 of threaded plug 142A.

With the embodiment of FIG. 5, which provides a means for communicating annulus fluid with the radial bore 128 so as to provide a radial inward force on the spherical ball 124 due to the pressure of the annulus fluid, it would be possible to eliminate the compression spring type biasing means 140.

Referring now to FIG. 6, a second alternative embodiment of an indexing means is generally designated by the numeral 64B.

In the indexing means 64B, the spherical ball 124 is closely received in a radial bore 128B. The inner diameter of radial bore 128B is slightly greater than the outer diameter of spherical ball 124.

A threaded plug retainer means 142B is disposed in a threaded counterbore 144B. An annular O-ring sealing means 146B provides a seal between plug 142B and a shoulder 148B. A compression spring biasing means 140B is located between ball 124 and plug 142B. The compression spring 140B directly engages the ball 124.

The general manner of operation of the downhole tool 10 is substantially the same as that of the Evans et al. tool described in detail in U.S. Pat. No. 4,113,012. That operation may generally be summarized as follows. The downhole tool 10 provides a circulation valve which may be moved between its open and closed positions by repeatedly increasing and decreasing the pressure in the annulus between the drill string and the well borehole. Annulus pressure is communicated with the upper end of power piston 61 through the power port 98. Exerted on the lower surface 71 of power piston 61 is the pressure of nitrogen gas contained in nitrogen chamber 78. The pressure of nitrogen gas within nitrogen chamber 78 is maintained at a predetermined differential below the annulus pressure by means of the flow restriction apparatus 92. The oil in oil chamber 80 is maintained at a pressure equal to the annulus pressure by means of the second floating piston 84, the lower end of which is communicated with annulus fluid through the port 86.

Upon repeated increasing and decreasing of the annulus pressure, the power piston 61 is caused to reciprocate relative to the housing 12 of downhole tool 10. This reciprocation causes the spherical ball 124 to move through the groove 112.

For example, the sectional view shown in FIG. 1C is taken along line 1C—1C of FIG. 4 with regard to the components of indexing sleeve 104. In FIG. 1C the spherical ball 124 is in the position illustrated in phantom lines in FIG. 4.

It can be seen that in FIG. 4., the pressure differential on power piston 61 is such that the power piston 61 is trying to move upward relative to housing 12. When the annulus pressure is next increased, the power piston 61 will move downward relative to housing 12 so that the spherical ball 124 will then be moved upward and to the left, from the position shown in FIG. 4, to the uppermost end of vertical groove portion 120. Then upon next decreasing the annulus pressure, the power piston will move upward relative to housing 12 so that the ball 124 then moves downward through vertical groove portion 120 and to the right into the first zig-zag of the lower zig-zag portion 118. Then, after five more repetitions of both increasing and decreasing the annulus pressure, the spherical ball 124 will move to the right all the way through the lower zig-zag portion 118 of groove 112 and will be located in the lower end of second vertical groove portion 122. Then upon the next increasing of annulus pressure, spherical ball member will move upward through the second vertical groove portion 122 and will once again be located in the upper zig-zag portion 116 of groove 112.

It can be seen that the circulation valve cover sleeve 32 can, therefore, be repeatedly moved between its open and closed positions by multiple repeated reciprocation of the piston 61 within the housing 12 due to changes in the annulus pressure.

The use of the indexing section 64 having a semi-circular cross-section groove 112 type of slot and having a spherical ball 124 type of lug, provides many advantages over the conventional lug and slot type indexing section as shown in FIGS. **2*b* and FIGS. 3–5** of the Evans et al. patent.

Expensive milling of lugs and slots is eliminated. The groove 112 and spherical ball 124 with its associated apparatus are much less expensive to manufacture than are machined slots and lugs.

The groove 112, although it has a very complex shape, is relatively easy to manufacture. A rough groove is first cut by the use of a conventional flat end mill. Then the final groove having the desired semi-circular cross-section is produced by the use of a ball nose mill, as will be understood by those skilled in the art. With complex groove arrangements such as the groove 112, the indexing sleeve 104 is preferably set up in a numerically controlled milling machine so that the cutting of the groove is controlled by taped instructions.

The spherical ball 124 greatly reduces friction between the housing 12 and the inner moving parts, thereby greatly increasing the life of the downhole tool 10.

The spherical ball 124 has more surface area in contact with the semi-circular cross-sectional groove, as compared to a conventional lug and slot, so that the stresses exerted on the groove are less.

The physical dimensions of the groove 112 and ball 124 are less than that of the comparable portions of the conventional slot and lug arrangement of Evans et al., so that more slots can be located around the circumference of the tool or longitudinally. With an increased number of slots, the load is distributed over more area, thereby reducing wear on the slots.

Also, when the spherical ball 124 wears out, it can be replaced very cheaply by merely removing the retainer plug 142 and pulling the biasing spring 140 and holding block 130 out of the bore 128 and replacing the spherical ball 124.

Thus, it is seen that the downhole tool of the present invention with the ball operated J-slot readily achieves the ends and advantages mentioned as well as those inherent therein. While presently preferred embodiments of the invention have been specifically described for the purpose of this disclosure, numerous changes in the arrangement and construction of parts can be made by those skilled in the art, which changes are encompassed within the spirit and scope of this invention as defined by the appended claims.

What is claimed is:

1. In a lug and slot assembly for guiding a relative movement between first and second telescoping tubular members of a downhole tool, the improvement comprising:

said slot having a semicircular cross section;

said lug being a spherical ball approximately one-half of which is received in said slot; and biasing means for resiliently biasing said ball toward said slot, said biasing means including a displaceable fluid under pressure.

2. The assembly of claim 1, wherein:

said biasing means further includes a compression spring.

3. A guide apparatus, comprising:

a first part having a groove disposed in a surface thereof;

a spherical ball engaging said groove for movement along said groove; and a second part including a holding means for holding said spherical ball relative to said second part and a biasing means for resiliently biasing said spherical ball toward said groove, so that movement of said second part relative to said first part is guided by said engagement of said ball and groove, said biasing means including a displaceable fluid under pressure.

4. The apparatus of claim 3, wherein:

said biasing means further includes a compression spring means for providing a portion of said resilient biasing of said spherical ball.

5. A downhole tool, comprising:

an outer cylindrical member having a longitudinal passageway disposed therein, said outer cylindrical member including a cylindrical inner surface defining a portion of said longitudinal passageway;

an inner cylindrical member having a cylindrical outer surface thereof closely received within said cylindrical inner surface of said outer cylindrical member;

a groove disposed in said cylindrical outer surface of said inner cylindrical member;

a spherical ball engaging said groove for movement along said groove; and a holding means for holding said spherical ball relative to said outer cylindrical member, said holding means including a radial bore disposed through a wall of said outer cylindrical member, said ball being disposed in said radial bore, so that movement of said outer cylindrical member relative to said inner cylindrical member is guided by engagement of said ball and groove.

6. The downhole tool of claim 5, further comprising:

biasing means for resiliently biasing said ball toward said groove.

7. The downhole tool of claim 5, being further characterized as a circulation valve, wherein:

said outer cylindrical member is further characterized as being a circulation valve housing having a circulating port disposed therethrough; and said inner cylindrical member is further characterized as including a sliding valve member movable between a closed position closing said circulating port and an open position opening said circulating port.

8. The downhole tool of claim 5, wherein:

said inner cylindrical member includes a cylindrical sleeve disposed thereon, said cylindrical outer surface in which said groove is disposed being defined as a cylindrical outer surface of said sleeve.

9. The downhole tool of claim 8, wherein:

said sleeve is freely rotatable relative to said inner cylindrical member.

10. The downhole tool of claim 9, wherein:

said slot is a continuous slot.

11. The downhole tool of claim 10, wherein said continuous slot includes:

an upper repeating zig-zag portion for rotating said sleeve in a first direction relative to said outer cylindrical member upon reciprocation of said inner cylindrical member relative to said outer cylindrical member;

a lower repeating zig-zag portion for rotating said sleeve in a second direction, opposite said first direction, relative to said outer cylindrical member upon reciprocation of said inner cylindrical member relative to said outer cylindrical member; and first and second vertical groove portions joining ends of said upper and lower zig-zag portions.

12. The downhole tool of claim 5, further comprising:

retainer means for retaining said ball in said radial bore.

13. The downhole tool of claim 12, wherein:

said ball is closely received in said radial bore, an inner diameter of said radial bore being slightly greater than an outer diameter of said ball.

14. The downhole tool of claim 13, further comprising:

biasing means for resiliently biasing said ball toward said groove.

15. The downhole tool of claim 14, wherein:

said biasing means includes a compression spring located between said ball and said retainer means.

16. The downhole tool of claim 15, wherein:

said compression spring directly engages said ball.

17. The downhole tool of claim 15, wherein:

said retainer means includes a threaded plug means received in a threaded radial counterbore located outward of said radial bore, for blocking said radial bore; and said downhole tool further includes annular seal means disposed between said plug means and a shoulder defined between said radial bore and said counterbore.

18. The downhole tool of claim 12, wherein:

said holding means further includes a holding block closely received in said radial bore and having a hemispherical cavity disposed in a radially inner surface thereof for receiving said ball.

19. The downhole tool of claim 18, wherein:

said retainer means includes a threaded plug blocking said radial bore outward from said holding block; and said downhole tool further includes compression spring biasing means compressed between said plug and said holding block.

20. The downhole tool of claim 19, wherein:

said threaded plug of said retainer means is received in a threaded radial counterbore located outward of said radial bore; and said downhole tool further includes annular seal means disposed between said plug means and a shoulder defined between said radial bore and said counterbore.

21. The downhole tool of claim 18, wherein:

said retainer means includes a threaded plug blocking said radial outward from said holding block, said plug having a fluid passage means disposed therethrough for communicating said radial bore with an outer surface of said outer cylindrical member; and said downhole tool further includes annular seal means disposed between said holding block and said radial bore.

22. The downhole tool of claim 21, further comprising:

biasing means for resiliently biasing said ball toward said groove.

23. The downhole tool of claim 22, wherein:

said biasing means includes a compression spring located between said plug and said holding block.

24. The downhole tool of claim 22, wherein:

said biasing means includes a displaceable fluid under pressure communicated with a radially outer end of said holding block through said fluid passage means of said threaded plug.

* * * * *